United States Patent [19]

Bidegain

[11] 4,202,117

[45] May 13, 1980

[54] SHOE, MORE PARTICULARLY FOR TODDLERS

[75] Inventor: Pierre Bidegain, Pau, France

[73] Assignee: Bidegain S.A., Pau, France

[21] Appl. No.: 5,854

[22] Filed: Jan. 23, 1979

[30] Foreign Application Priority Data

Nov. 3, 1978 [FR] France ..... 78 31111

[51] Int. Cl.[2] ..... A43B 3/30

[52] U.S. Cl. ..... 36/112; 36/105; 36/71

[58] Field of Search ..... 36/112, 105, 71, 69, 36/68

[56] References Cited

U.S. PATENT DOCUMENTS

| | | | |
|---|---|---|---|
| 2,578,681 | 12/1951 | Everston | 36/105 |
| 2,603,890 | 7/1952 | Everston | 36/105 |
| 3,500,561 | 3/1970 | Epstein | 36/112 |

FOREIGN PATENT DOCUMENTS

| | | | |
|---|---|---|---|
| 260051 | 2/1968 | Austria | 36/71 |
| 6804700 | 10/1968 | Netherlands | 36/71 |

*Primary Examiner*—James Kee Chi

*Attorney, Agent, or Firm*—Young & Thompson

[57] ABSTRACT

A shoe, more particularly for toddlers, comprises at the back, from bottom to top, successive zones of decreasing rigidity and increasing flexibility, namely a first zone comprising, from inside to outside, a soft lining, a foam filling, an inner reinforcement, a flexible body and an upward extension of the outer sole; a second zone comprising, from inside to outside, the soft lining, the foam filling, the inner reinforcement and the flexible body; a third zone comprising, from inside to outside, the soft lining, the foam filling and the flexible body; and a fourth zone comprising a foam cushion surrounded by the soft lining. The sole preferably also comprises an upward extension at the front. The foot is perfectly protected and supported, very comfortably and softly.

6 Claims, 4 Drawing Figures

15
16
15
12
14
13
C
C1
18
17
Z4
Z3
Z2
19
Z1
10A
10B
11
10
12
23

25
19
10B
10
24
23

II
16
22
12
II
19
C
12A
12B
20
21
10
12
23

19
10A
IV
10
23

SHOE, MORE PARTICULARLY FOR TODDLERS

BACKGROUND OF THE INVENTION

1. Field of the Invention

This invention relates to a shoe, more particularly for toddlers.

2. Description of the Prior Art

Shoes for toddlers are known comprising an outer sole, a primary sole, a flexible body, an inner reinforcement located at the back of the flexible body and extending from the base of the flexible body to an upper end spaced from the top of the flexible body, and a foam cushion located at the back at the top of the flexible body.

The rear inner reinforcement supports the child's foot whilst the foam cushion, located above this reinforcement permits easy bending of the ankle without damaging the tendon.

However, the inventor realised that children's feet, particularly when they are just beginning to walk, are only partly developed anatomically and are still weak and frail and that the shoes which are most suitable are those which provide the best protection and support, whilst being comfortable and very soft; these two apparently contradictory conditions have not been fulfilled entirely satisfactorily until now.

SUMMARY OF THE INVENTION

This invention has for its object to provide a shoe, particularly for toddlers, which provides good protection and excellent support whilst being very comfortable and extremely soft.

According to the invention, this shoe comprises at the back, from the base to the top, successive zones of decreasing rigidity and increasing flexibility, namely a first zone comprising, from inside to outside, a soft lining, a foam filling, an inner reinforcement, a flexible body and an upward extension of the outer sole; a second zone comprising, from inside to outside, the soft lining, the foam filling, the inner reinforcement and the flexible body; a third zone comprising, from inside to outside, the soft lining, the foam filling and the flexible body; and a fourth zone comprising a foam cushion surrounded by the soft lining.

Thanks to this arrangement, the base of the child's heel is perfectly supported and protected from impact from behind by the upward extension of the rear part of the outer sole, with a particularly effective intermediate support for the heel. Lateral torsion of the base of the shoe at the back is prevented to the maximum degree by the inner reinforcement and the upward shape of the sole. At the same time, comfort for the heel is ensured by the soft lining and the foam filling.

Moreover, in the upper part, optimum flexibility is obtained owing to the fact that, between the reinforcement and the upper foam cushion, there is provided an intermediate zone, i.e. the third zone mentioned hereinbefore, where only the soft lining, the foam filling and the flexible body are provided; the existence of this zone means that, whilst retaining the excellent support afforded by the reinforcement, a preferential fold line is obtained about which the foam cushion can pivot through a few degrees, thus substantially increasing the effectiveness of this cushion in permitting bending of the ankle whilst preventing irritation of the tendon.

Preferably, according to another feature, the front part of the outer sole is also upwardly extended, thus matching the raised rear part of this outer sole, to ensure excellent balance of the shoe, on the one hand, and effectively protect the toes, on the other hand, just as the upward extension of the rear part of the outer sole protects the base of the heel.

Thus, the child can step out with either the back or front of the foot, as frequently occurs with small children, and the heel and toes will be protected from impact. Moreover, the upward extensions of the outer sole at both front and back protect the flexible body of the shoe and consequently add to the life of the shoe.

DETAILED DESCRIPTION OF THE INVENTION

Figure 2:
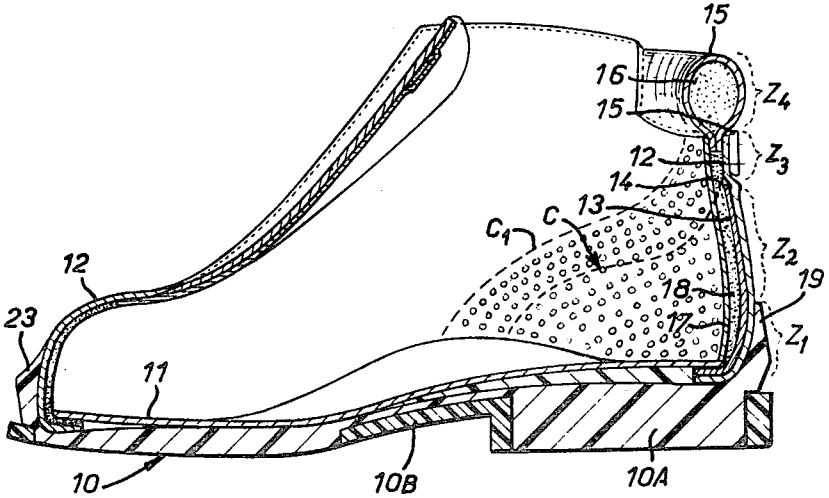
FIG. 2 is a vertical section through this shoe on the line II—II in FIG. 1.
Figure 4:
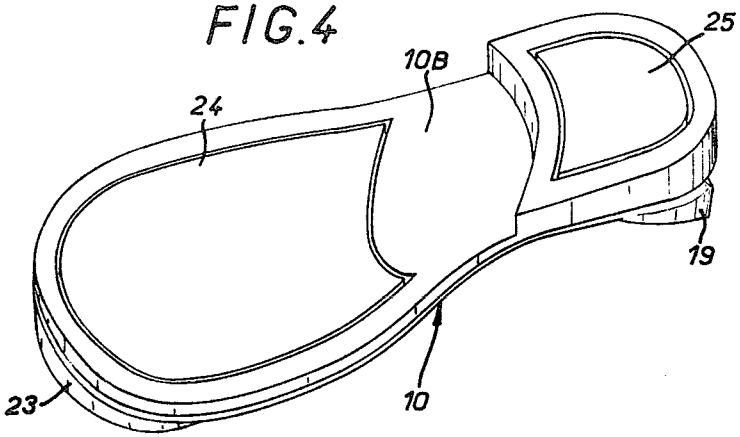
FIG. 4 is a view of this outer sole from below, in the direction of the arrow IV in FIG. 2.

In the embodiment shown in FIGS. 1 to 4, which relates, by way of a non-restrictive example, to an application of the invention to a shoe for toddlers, the shoe comprises an outer sole 10, a primary sole 11, a flexible body 12, an inner reinforcement 13 located at the back of the body 12 and extending from the base of the body to an upper end 14 spaced from the top 15 of the flexible body 12, and a foam cushion 16 located at the back and at the top of the body 12.

From bottom to top (FIG. 2), the shoe comprises at the back successive zones of decreasing rigidity and increasing flexibility, namely:

(1) a first zone Z1 comprising, from inside to outside, a soft lining 17, a foam filling 18, the reinforcement 13, the flexible body 12 and an upward extension 19 of the outer sole 10;

(2) a second zone Z2 comprising, from inside to outside, the soft lining 17; the foam filling 18, the inner reinforcement 13 and the flexible body 12;

(3) a third zone Z3 comprising, from inside to outside, the soft lining 17, the foam filling 18 and the flexible body 12;

(4) a fourth zone Z4 comprising the foam cushion 16 plus the soft lining such as 17 which surrounds this foam cushion.

The child's heel is perfectly protected at the bottom by the combined action of the extension 19 of the sole 10 and the inner reinforcement 13 whereas, at the top, there is provided, between the end 14 of the inner reinforcement 13 and the foam cushion 16, a strip which is particularly adapted to bend, consisting of the zone Z3 which comprises only the flexible body 12, the soft lining 17 and the foam filling 18, all of which are extremely supple.

This arrangement results in a considerable improvement in the softening effect expected of the cushion 16, since the zone Z3 constitutes a sort of pivot line about which the foam cushion 16 can adapt perfectly to front or back movements of the ankle. In addition, the bottom rear end of the heel is firmly supported by the zone Z1 and the entire heel is also well supported by the zone Z2, as is appropriate, owing to the enveloping form of the inner reinforcement 13.

Figure 1:
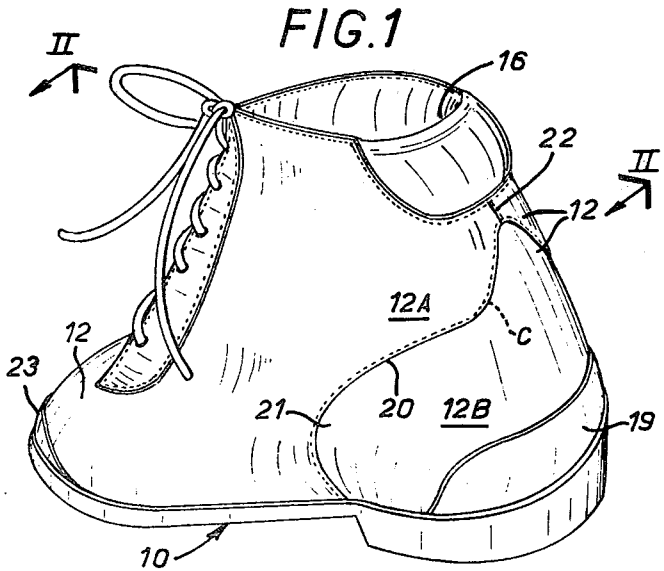
FIG. 1 is a perspective three-quarter view from behind of a shoe according to the invention.
Figure 3:
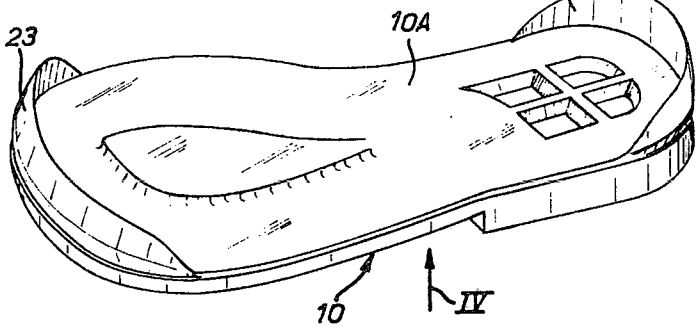
FIG. 3 is a perspective view of only the outer sole.

At the back of the shoe, the body 12 is in two parts 12A and 12B (FIG. 1) which are stitched to each other at 20 and comprise a covering strip along the zone Z3, substantially following the contour C of the reinforcement 13 (FIGS. 1 and 2). This contour C has two side parts 21 and a central upward projection 22 which improves the resistance to lateral torsion.

The foam filling 18 has a contour C1 (FIG. 2) which extends beyond the contour C and even beyond the covering strip of the two parts 12A and 12B of the body 12 corresponding to the zone Z3, so as to overlap this zone Z3 and provide excellent comfort whilst preventing the foot from becoming sensitised by the change in rigidity between the various zones.

The outer sole 10 comprises, at the front, an upward extension 23 which matches the rear upward extension 19 of this sole 10.

Thus, the child is protected at the toes and the heel when he walks on the tips of his toes or on his heels, these being favourite positions but not generally entirely safe.

Furthermore, thanks to the upward extension of the sole 10 at both the front 23 and back 19, the body 12 is protected from scuffs which frequently occur at these points, and hence the life of the shoe is increased.

Preferably, the outer sole 10 is made up of two materials of different kinds.

In one embodiment, the outer sole 10 is made entirely of moulded plastics or natural rubber or elastomer: on the one hand, a material 10A constituting the extensions 19 and 23 and non-slip areas underneath the shoe at 24 and 25 (FIG. 4) and, on the other hand, a material 10B intercalated with the preceding one and constituting the periphery of the underside of the shoe, as well as the intermediate zone between the non-slip areas 24 and 25. The sole 10 as a whole, made up of these two constituent parts 10A and 10B, is produced by moulding, which ensures that these two parts 10A and 10B are perfectly integrated.

As a variant, the material 10A consists of moulded plastics, natural rubber or elastomer and forms the whole of the load-bearing surface of the heel 25 of the sole 10 as well as the non-slip area 24 and the extensions 19 and 23, whilst the material 10B consists of cutouts from a sheet of leather or elastomer and constitutes the periphery of the front and the entire back part of the sole 10 to which the heel 25 is attached. In this variant, the two materials are assembled by adhesive bonding or by injecting the material 10A on to the material 10B.

I claim:

1. A shoe, more particularly for toddlers, comprising an outer sole, a primary sole, a flexible body, a rear reinforcement located at the back of the body and extending from the base of the flexible body to an upper end spaced from the top of the flexible body, and a foam cushion arranged at the back and at the top of the body, wherein said shoe comprises at the back, from the bottom to the top, successive zones of decreasing rigidity and increasing flexibility; namely a first zone comprising, from inside to outside, a soft lining, a foam filling, said rear reinforcement, said flexible body and an upward extension of the outer sole; a second zone comprising, from inside to outside, said soft lining, said foam filling, said inner reinforcement and said flexible body; a third zone comprising, from inside to outside, said soft lining, said foam filling and said flexible body; and a fourth zone comprising said foam cushion surrounded by said soft lining.

2. A shoe according to claim 1, wherein the outer sole has an upward extension at the front of the outer sole which matches the upward extension at the back of the outer sole.

3. A shoe according to claim 2, wherein the outer sole is in two assembled parts, one of which comprises said upward extensions at both front and back whilst the other part comprises at least part of the underside of the sole.

4. A shoe according to claim 1, wherein at the back of the shoe, the body is in two parts stitched to each other, with a covering which is located near the contour of the rear reinforcement.

5. A shoe according to claim 4, wherein the said contour of the rear reinforcement is such that it envelops the sides of the heel and comprises at the back a slight upward projection for supporting the rear part of the tendon without conflicting with the lateral movements of the foot.

6. A shoe according to claim 1, wherein the foam filling overlaps the contour of the rear reinforcement and also the contour of the covering strip of the two parts of the body.

* * * * *